US009463886B2

(12) United States Patent
Dominguez, Jr. et al.

(10) Patent No.: US 9,463,886 B2
(45) Date of Patent: Oct. 11, 2016

(54) BAG FORMER ASSEMBLY

(75) Inventors: John Dominguez, Jr., Houston, TX (US); John Dominguez, III, Houston, TX (US); Raul Menchaca, Houston, TX (US)

(73) Assignee: J & F BUSINESS, INC., Pasadena, TX (US)

( * ) Notice: Subject to any disclaimer, the term of this patent is extended or adjusted under 35 U.S.C. 154(b) by 889 days.

(21) Appl. No.: 13/453,820

(22) Filed: Apr. 23, 2012

(65) Prior Publication Data

US 2012/0270711 A1 Oct. 25, 2012

Related U.S. Application Data

(60) Provisional application No. 61/477,975, filed on Apr. 21, 2011.

(51) Int. Cl.

| | |
|---|---|
| ***B31B 19/00*** | (2006.01) |
| ***B23P 19/00*** | (2006.01) |
| ***B65B 9/22*** | (2006.01) |
| ***B65B 59/04*** | (2006.01) |

(52) U.S. Cl.

CPC ..... *B65B 9/22* (2013.01); *B65B 59/04* (2013.01); *Y10T 29/49815* (2015.01)

(58) Field of Classification Search

CPC ..... B31B 19/26; B31B 19/00; B65B 9/22; B65B 9/213; B65B 9/20; Y10T 29/49815

USPC ..... 493/186, 196, 302, 308; 29/426.1; 53/451, 551, 552, 575, 578

See application file for complete search history.

(56) References Cited

U.S. PATENT DOCUMENTS

| | | | | |
|---|---|---|---|---|
| 6,170,227 | B1 | 1/2001 | Kovacs et al. | |
| 6,341,473 | B1 | 1/2002 | Kovacs et al. | |
| 6,513,308 | B1 | 2/2003 | Meeuwesen et al. | |
| 6,619,018 | B1 * | 9/2003 | Sasaki | 53/511 |
| 7,523,597 | B2 * | 4/2009 | Dominguez et al. | 53/451 |

(Continued)

FOREIGN PATENT DOCUMENTS

| | | |
|---|---|---|
| DE | 19858567 A2 | 6/2000 |
| EP | 1077176 A1 | 2/2001 |

(Continued)

OTHER PUBLICATIONS

Patent Cooperation Treaty; PCT International Search Report; Issued in Connection with PCT/US2012/034704; Aug. 21, 2012; 5 pages; Europe.

Patent Cooperation Treaty; PCT Written Opinion of the International Searching Authority; Issued in Connection with PCT/US2012/034704; Aug. 21, 2012; 5 pages; Europe.

*Primary Examiner* — Robert Long
*Assistant Examiner* — Xavier A Madison
(74) *Attorney, Agent, or Firm* — Greenberg Traurig LLP

(57) ABSTRACT

The present invention provides a former assembly. The former assembly can include a base plate having an aperture that extends from a first surface to a second surface thereof. A bracing post can be attached to the base plate on the first surface proximate the aperture. The bracing post can have a receiving orifice formed therein. A substantially rigid tube can be adapted to extend through the aperture in the base plate. An annular space can be formed between the tube and the base plate. The annular space can be sized for the passage of the flexible sheet material.

19 Claims, 14 Drawing Sheets

(56) References Cited

U.S. PATENT DOCUMENTS

| | | | |
|---|---|---|---|
| 2008/0229712 | A1 | 9/2008 | Dominguez et al. |
| 2009/0288373 | A1 | 11/2009 | Feijen |

FOREIGN PATENT DOCUMENTS

| | | | |
|---|---|---|---|
| EP | 2128028 | A2 | 12/2009 |
| WO | WO 0027619 | A1 | 5/2000 |

* cited by examiner

BAG FORMER ASSEMBLY

CROSS REFERENCE TO RELATED APPLICATIONS

This application claims the benefit, and priority benefit, of U.S. Provisional Patent Application Ser. No. 61/477,975, filed Apr. 21, 2011, titled "BAG FORMER ASSEMBLY," the disclosure of which is incorporated by reference herein in its entirety.

BACKGROUND

1. Field of Invention

This invention relates generally to product packaging, and more particularly to a bag former assembly for preparing product packaging.

2. Description of the Related Art

It is known in the art to utilize bag former assemblies to fabricate packaging for bulk consumer products, particularly foodstuffs. Certain previous bag former assemblies lack stability and are difficult and time consuming to disassemble and reassemble for cleaning and maintenance purposes.

SUMMARY

The present subject matter generally relates to a former assembly for preparing product packaging. Former assembly can be utilized to fabricate bags from flexible sheet material. The former assembly is preferably stable, durable and easy to assemble and disassemble for cleaning purposes.

In certain illustrative embodiments, the former assembly can include a base plate having an aperture that extends from a first surface to a second surface thereof. A bracing post can be attached to the base plate on the first surface proximate the aperture. The bracing post can have a receiving orifice formed therein. A substantially rigid tube can be adapted to extend through the aperture in the base plate. An annular space can be formed between the tube and the base plate. The annular space can be sized for the passage of the flexible sheet material.

A bracing arm can be attached to the tube and adapted to fit within the receiving orifice. The bracing arm can be attached to the tube at a single location, or at a plurality of spaced-apart locations.

The bracing post and receiving orifice can have any desired shape, including but not limited to substantially circular in cross section. The bracing arm can include a handle arm with a stabilizer member extending therefrom. The stabilizer member can be adapted to fit within the receiving orifice of the bracing post.

The bracing post can have a slot formed therein. A section of the handle arm can be adapted to fit within the slot when the stabilizer member is fitted within the receiving orifice.

The bracing arm can have a shoulder with a downward facing engagement surface formed thereon. The bracing post can have a shoulder with an upward facing engagement surface formed thereon. The engagement surface of the bracing arm can adapted to contact the engagement surface of the bracing post when the bracing arm is fitted within the receiving orifice and slid a sufficient distance therein. The bracing post can be attached to the base plate with a plurality of fasteners such that rotation of the bracing post about its longitudinal axis is inhibited.

In another illustrative embodiment, a former assembly for forming bags from flexible sheet material is provided. A base plate can be provided having an aperture extending from a first surface to a second surface thereof. A bracing post can be attached to the base plate on the first surface proximate to the aperture. The bracing post can have a receiving orifice formed therein and extending longitudinally therethrough. A fill tube can be slidingly passable through the aperture in the base plate with an annulus between the fill tube and the base plate sized for the passage of the flexible sheet material. A bracing arm can be attached to the fill tube and slidingly fittable within the receiving orifice.

In certain embodiments, a first shoulder can be disposed on the bracing arm with a downward facing engagement surface and a second shoulder can be disposed on the bracing post with an upward facing engagement surface, such that the downward facing engagement surface is capable of contacting the upward facing engagement surface when the bracing arm is slidingly fitted into the receiving orifice. A support arm can extend from the bracing arm and a slot can be formed in the bracing post adjacent to the receiving orifice, such that the slot is sized to receive the support arm when the bracing arm is slidingly fitted into the receiving orifice. The support arm can be affixed, or not affixed, to the fill tube.

The assembly can also include a first locking orifice formed in the bracing post, a second locking orifice formed in the bracing arm, and a locking pin slidingly fittable within the first locking orifice. The second locking orifice can be capable of securing the bracing arm to the bracing post. The bracing arm can have a stabilizer member attached thereto and extending therefrom that is slidingly fittable into the receiving orifice and aligned in a plane that is parallel to the plane of the bracing post. The bracing arm can include a plurality of contact arms attached to the fill tube at spaced apart locations, a handle arm disposed between the contact arms, and a stabilizer member that is slidingly fittable into the receiving orifice.

In another illustrative embodiment, a method of removing a fill tube from a former assembly for fabricating bags from flexible sheet material is provided. A base plate can be provided with an aperture extending from a first surface to a second surface thereof and a bracing post attached to the base plate on the first surface proximate to the aperture, the bracing post having a receiving orifice formed therein. A fill tube can be provided having a bracing arm attached thereto, the fill tube disposed in the aperture in the base plate. The fill tube can be slidingly passed out of the aperture in the base plate. The bracing arm can be slidingly removed from the receiving orifice. A support arm can be provided that extends from the bracing arm. A slot can be formed in the bracing post adjacent to the receiving orifice, and the support arm can be slidingly removed from the slot. A first locking orifice can be provided that is formed in the bracing post. A second locking orifice can be provided that is formed in the bracing arm. A locking pin can be removed from the first locking orifice and the second locking orifice to unsecure the bracing arm from the bracing post.

In another illustrative embodiment, a method of replacing a fill tube on a former assembly for fabricating bags from flexible sheet material is provided. A base plate can be provided with an aperture extending from a first surface to a second surface thereof and a bracing post attached to the base plate on the first surface proximate to the aperture, the bracing post having a receiving orifice formed therein. A fill tube can be provided having a bracing arm attached thereto. The fill tube can be slidingly passed through the aperture in the base plate. An annulus can be provided between the fill tube and the base plate sized for the passage of the flexible sheet material. The bracing arm can be slidingly fitted into the receiving orifice. A support arm can be provided extending from the bracing arm. A slot can be formed in the bracing post adjacent to the receiving orifice. The support arm can be slidingly fitted into the slot. A first locking orifice can be provided that is formed in the bracing post. A second locking orifice can be provided that is formed in the bracing arm. A locking pin can be inserted within the first locking orifice and the second locking orifice to secure the bracing arm to the bracing post.

Other aspects and features of the present invention will become apparent to those of ordinary skill in the art upon review of the following detailed description in conjunction with the accompanying figures.

BRIEF DESCRIPTION OF THE DRAWINGS

A better understanding of the presently disclosed subject matter can be obtained when the following detailed description is considered in conjunction with the following drawings, wherein.

Figure 1:
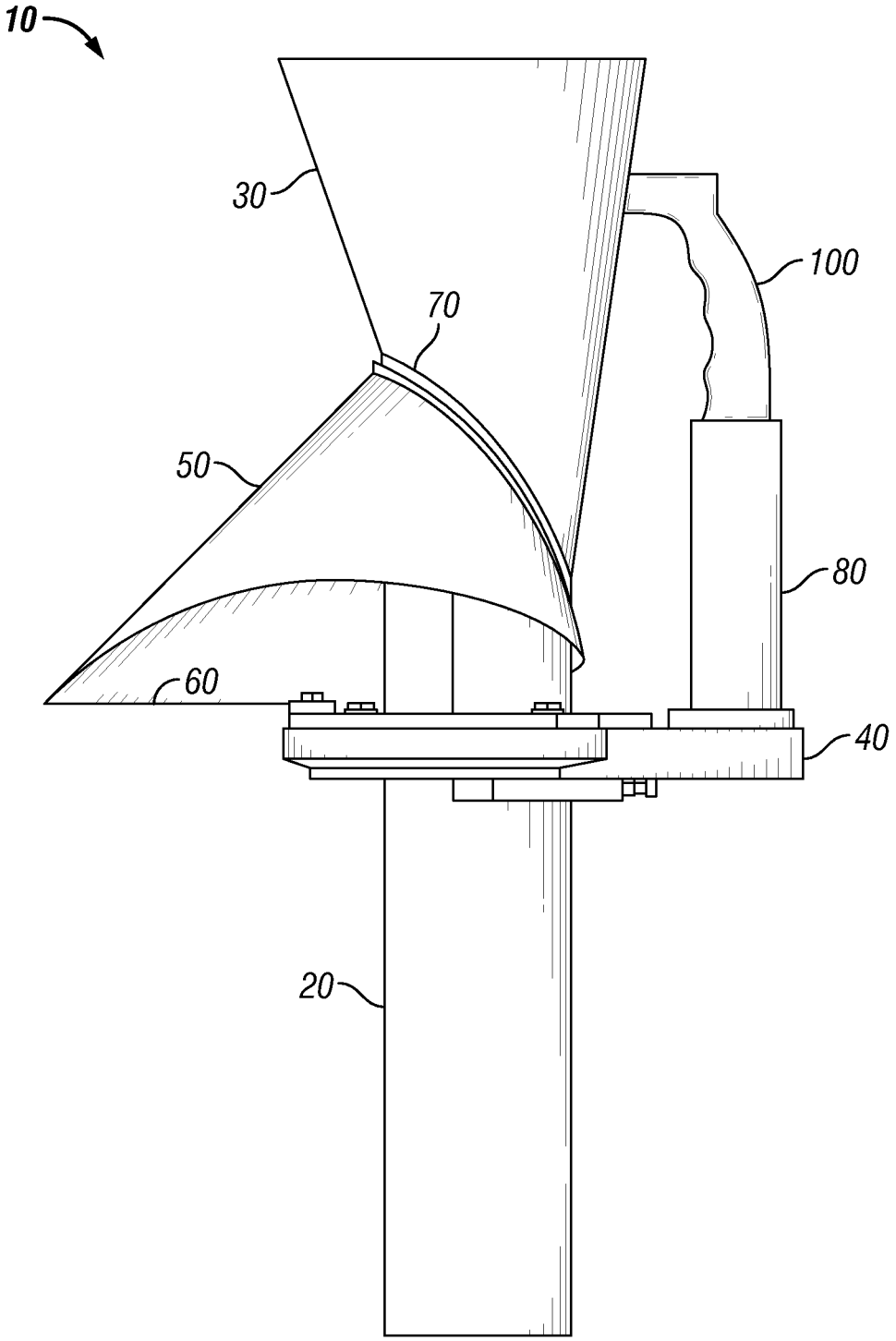
FIG. 1 is a side view of a former assembly with a single contact arm in an illustrative embodiment.
Figure 2:
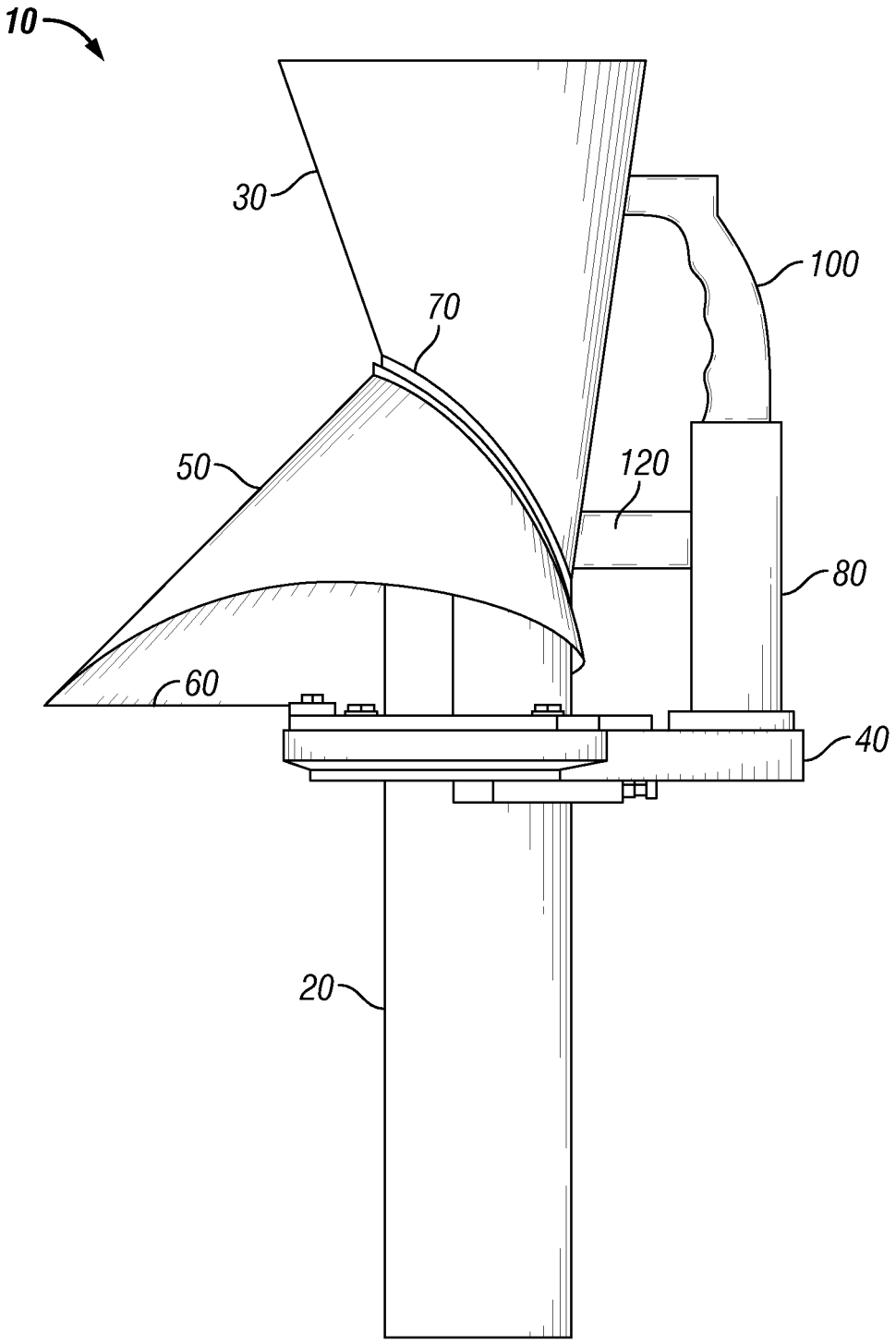
FIG. 2 is a side view of a former assembly with a plurality of contact arms in an illustrative embodiment.
Figure 3:
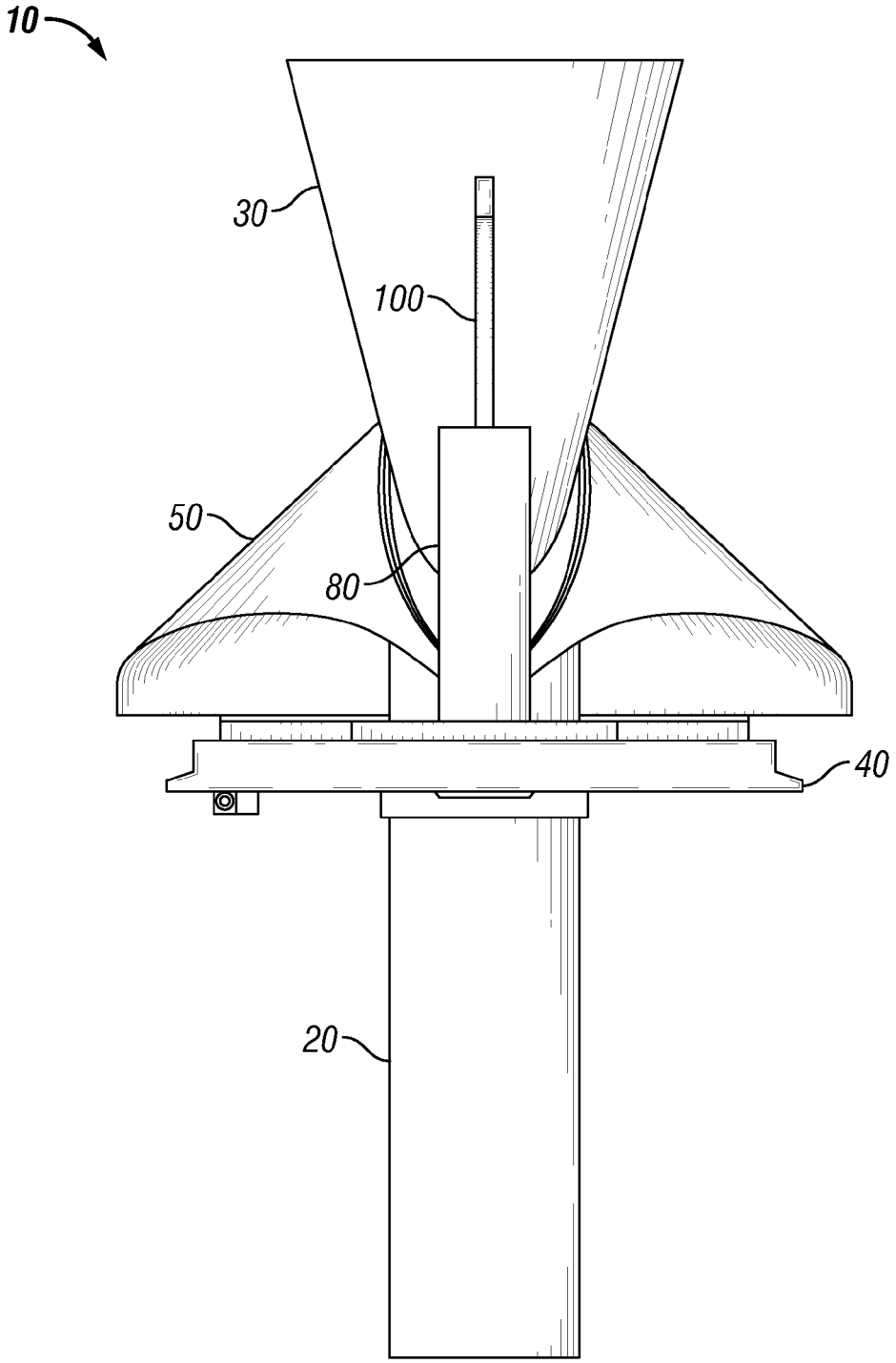
FIG. 3 is a front view of a former assembly in an illustrative embodiment.
Figure 4:
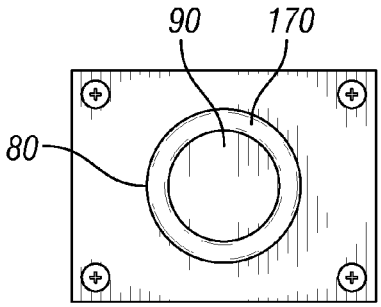
FIG. 4 is a top view of a bracing post for a former assembly in an illustrative embodiment.
Figure 6:
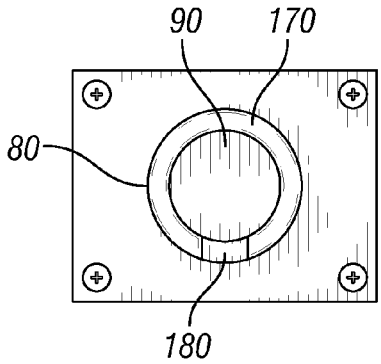
FIG. 6 is a top view of a bracing post with a slot formed therein for a former assembly in an illustrative embodiment.
Figure 5:
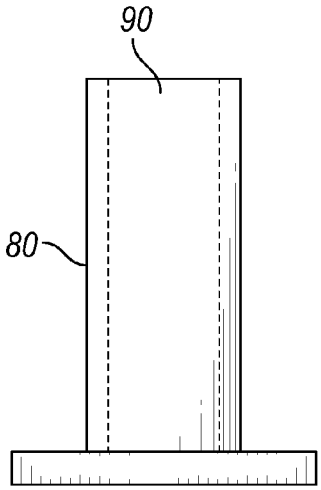
FIG. 5 is a side view of a bracing post for a former assembly in an illustrative embodiment.
Figure 7:
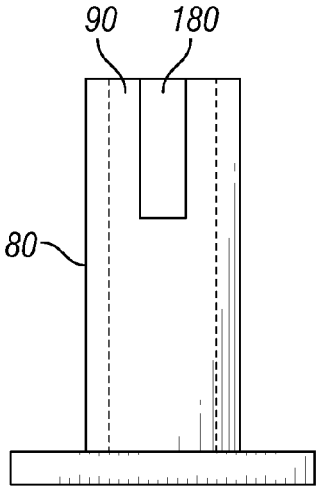
FIG. 7 is a side view of a bracing post with a slot formed therein for a former assembly in an illustrative embodiment.

While certain preferred illustrative embodiments will be described herein, it will be understood that this description is not intended to limit the subject matter to those embodiments. On the contrary, it is intended to cover all alternatives, modifications, and equivalents, as may be included within the spirit and scope of the subject matter as defined by the appended claims.

DETAILED DESCRIPTION

Referring now to FIGS. 1-26, various illustrative embodiments of a former assembly 10 are provided herein. Former assembly 10 can be utilized to form and fabricate bags from flexible sheet material. Former assembly 10 can be reproducibly positioned on automated equipment for filling said bags with a selected product. Methods of removing or replacing a fill tube on former assembly 10 for fabricating bags from flexible sheet material are also provided herein.

In certain illustrative embodiments, former assembly 10 can comprise a generally cylindrical fill tube 20 whose upper portion may have a progressively expanding diameter so as to form funnel section 30 which facilitates entry of product into fill tube 20.

Base plate 40 provides structural support for various components of former assembly 10 and may be equipped with conventional means for bracing or securing assembly 10 on automated packaging equipment. A central aperture 310 in base plate 40 is sized to accommodate fill tube 20 such that an annulus 320 is formed in the space between fill tube 20 and base plate 40 when fill tube 20 is positioned inside base plate 40. The annulus 320 permits the passage of packaging material through base plate 40 around the outer circumference of fill tube 20.

Base plate 40 also supports a former wing 50 by means of wing support 60. Former wing 50 surrounds but does not contact tube 20, leaving gap 70 between the two members for the passage of flexible sheet material. The sheet material can be advanced through assembly 10 via a pull down mechanism.

The existence of gap 70 and the annulus 320 in base plate 40 requires that fill tube 20 be suspended from one or more points above base plate 40. At least one suspension point must also be above gap 70 so as to not interfere with the movement of the sheet material across former wing 50.

In certain illustrated embodiment, a bracing post or stanchion 80 can securely attached at its bottom surface [not shown] to base plate 40 with a plurality of bolts (or other fastening means) so as to prevent any rotation of bracing post 80 on base plate 40. Various illustrative embodiments of bracing post 80 are shown in FIGS. 4-7. In certain illustrative embodiments, bracing post 80 can have a generally circular cross section. A receiving orifice 90 can be formed within bracing post 80, and extend longitudinally therethrough. The receiving orifice 90 can extend throughout the entire longitudinal extent of bracing post 80, or alternatively, can extend only partially therethrough. In certain illustrative embodiments, receiving orifice 90 can also have a generally circular cross section, although the cross section of receiving orifice 90 will necessarily be smaller than the cross section of bracing post 80.

Figure 10:
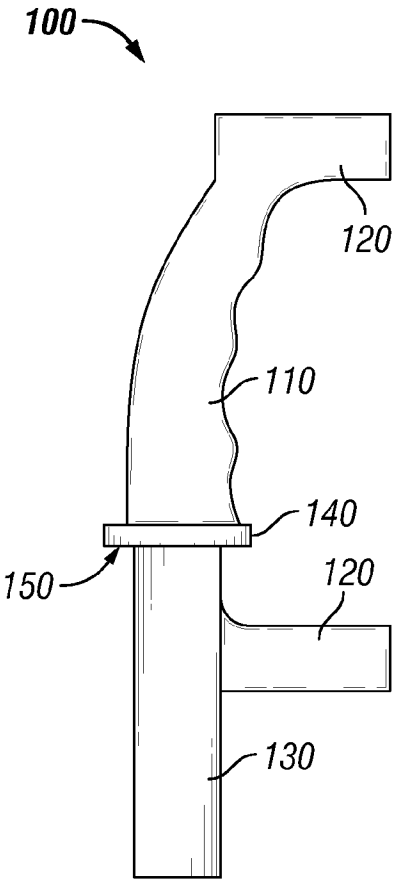
FIG. 10 is a side view of a bracing arm with a plurality of contact arms and a stabilizer member disposed thereon for a former assembly in an illustrative embodiment.
Figure 9:
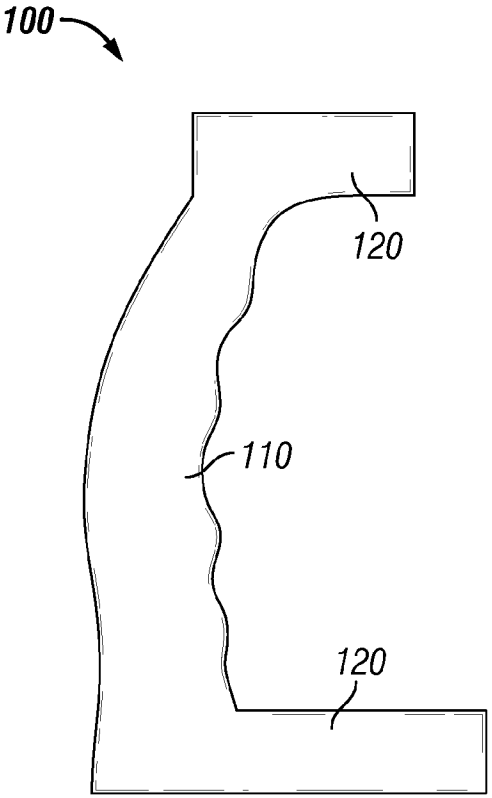
FIG. 9 is a side view of a bracing arm with a plurality of contact arms for a former assembly in an illustrative embodiment.
Figure 8:
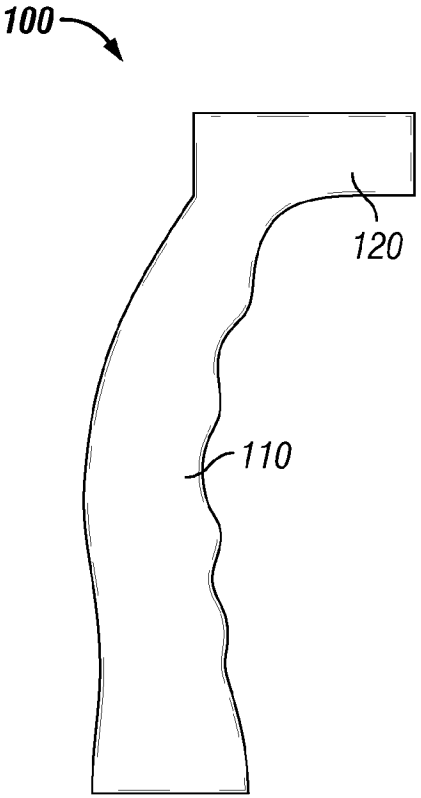
FIG. 8 is a side view of a bracing arm with a single contact arm for a former assembly in an illustrative embodiment.
Figure 11:
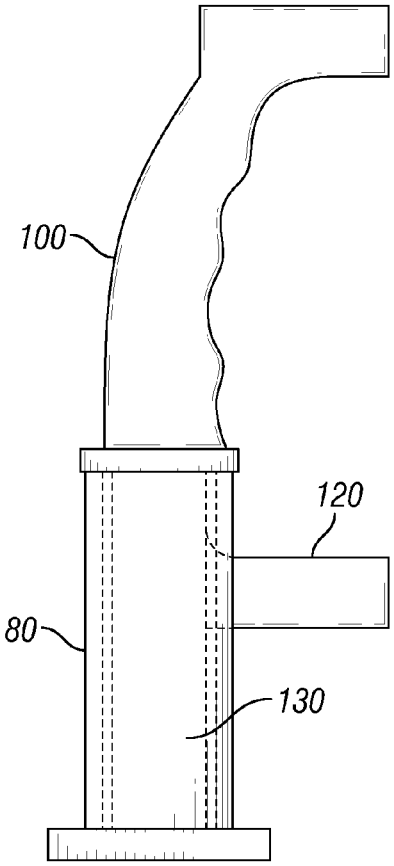
FIG. 11 is a side view of a bracing arm having a stabilizer member and a contact arm, wherein the stabilizer member is fully disposed within a receiving orifice of a bracing post of a former assembly in an illustrative embodiment.
Figure 12:
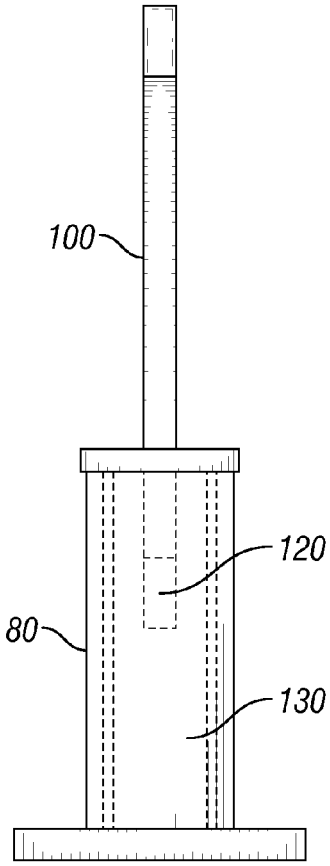
FIG. 12 is a front view of a bracing arm having a stabilizer member and a contact arm, wherein the stabilizer member is fully disposed within a receiving orifice of a bracing post of a former assembly in an illustrative embodiment.
Figure 13:
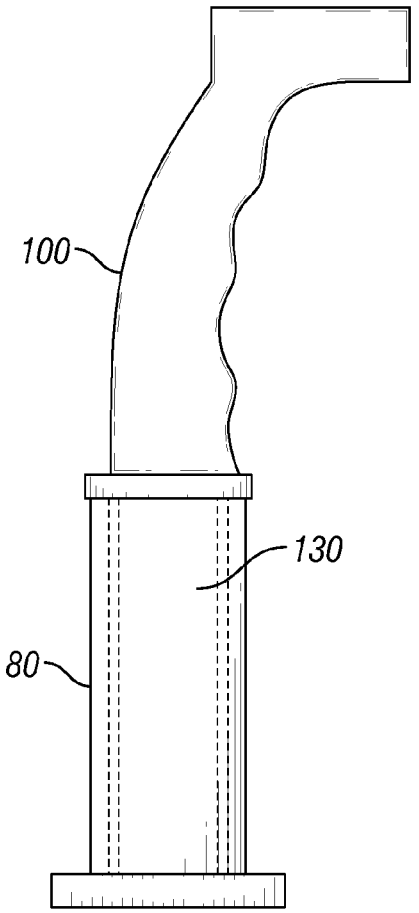
FIG. 13 is a side view of a bracing arm having a stabilizer member that is fully disposed within a receiving orifice of a bracing post of a former assembly in an illustrative embodiment.
Figure 14:
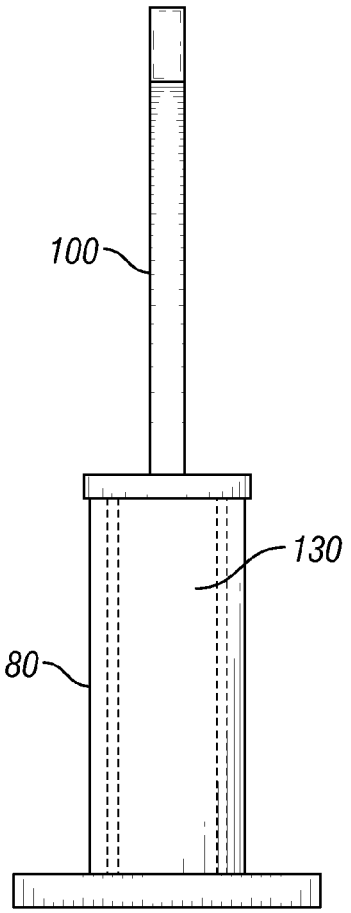
FIG. 14 is a front view of a bracing arm having a stabilizer member that is fully disposed within a receiving orifice of a bracing post of a former assembly in an illustrative embodiment.
Figure 15:
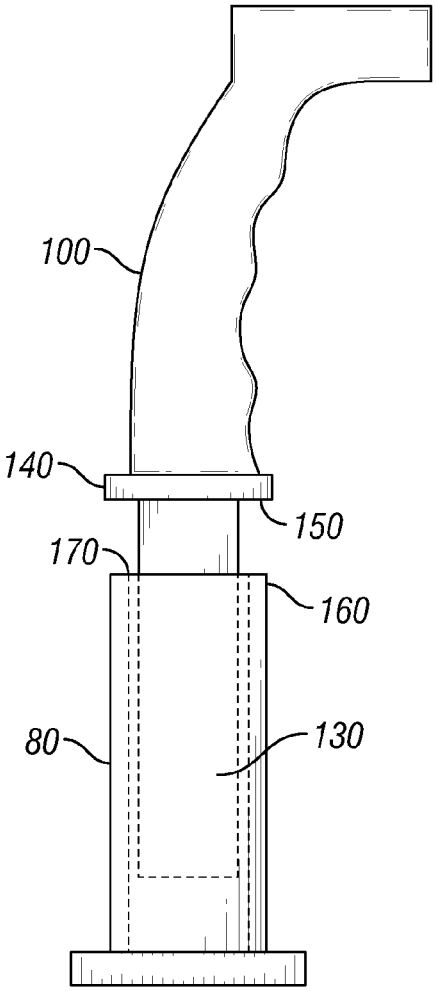
FIG. 15 is a side view of a bracing arm having a stabilizer member that is partially disposed within a receiving orifice of a bracing post of a former assembly in an illustrative embodiment.
Figure 16:
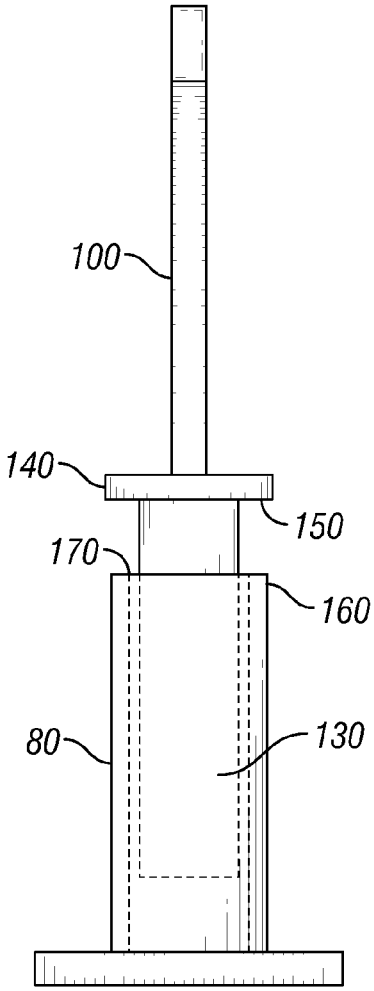
FIG. 16 is a front view of a bracing arm having a stabilizer member that is partially disposed within a receiving orifice of a bracing post of a former assembly in an illustrative embodiment.
Figure 17:
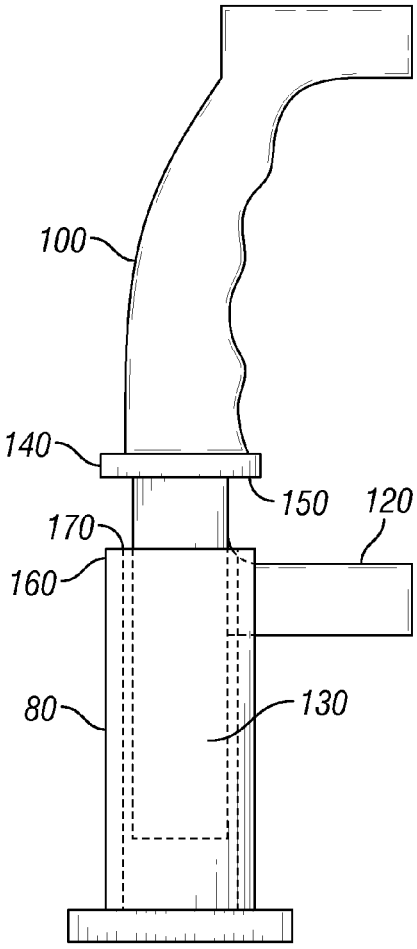
FIG. 17 is a side view of a bracing arm having a stabilizer member and a contact arm, wherein the stabilizer member is partially disposed within a receiving orifice of a bracing post of a former assembly in an illustrative embodiment.
Figure 18:
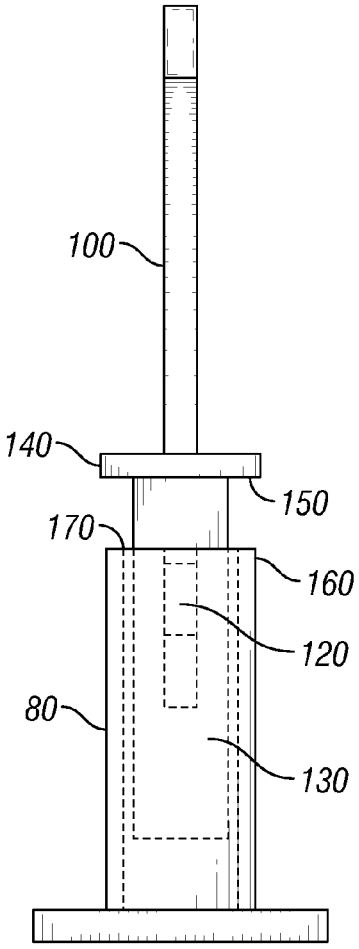
FIG. 18 is a front view of a bracing arm having a stabilizer member and a contact arm, wherein the stabilizer member is partially disposed within a receiving orifice of a bracing post of a former assembly in an illustrative embodiment.
Figure 19:
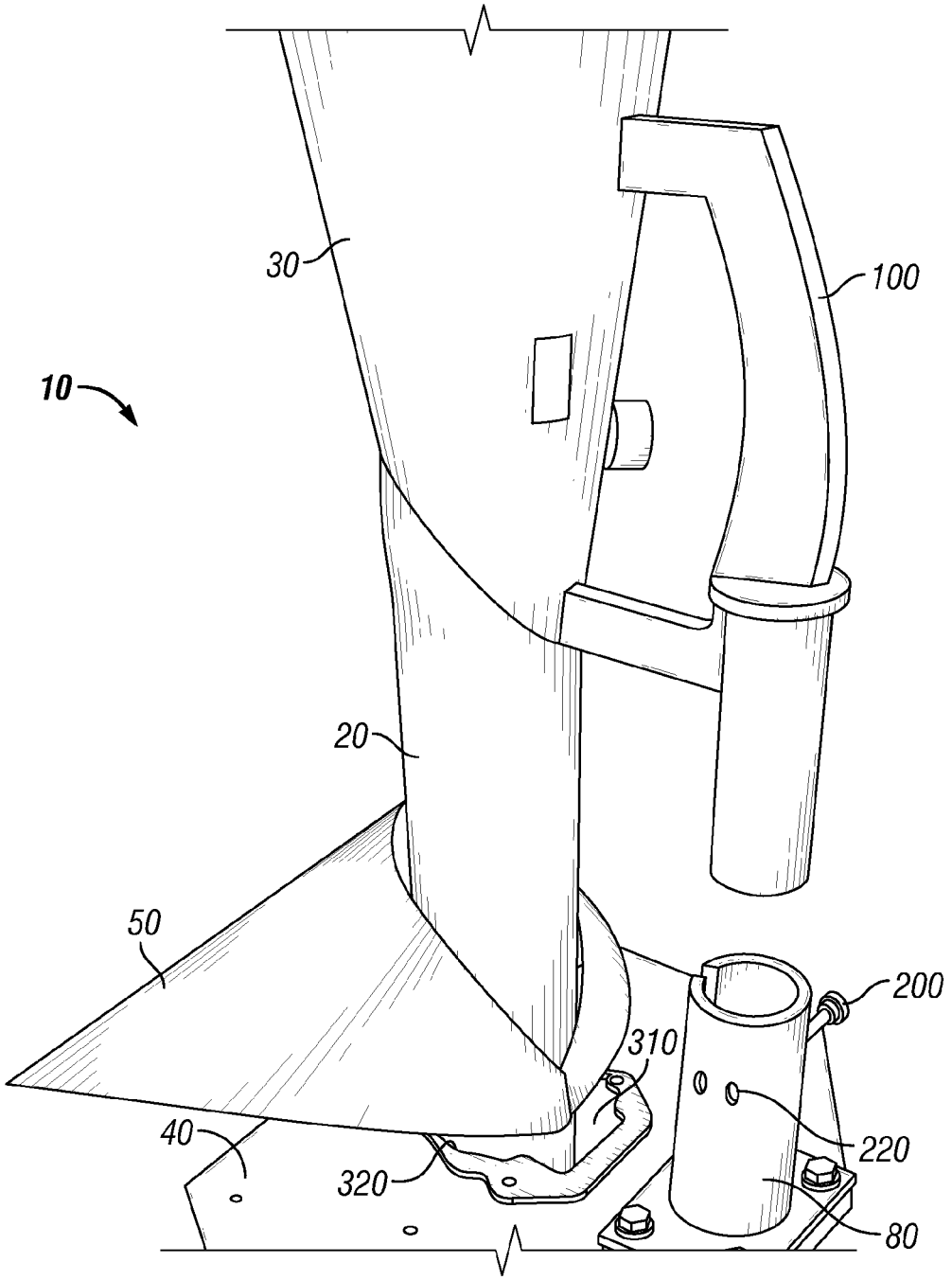
FIG. 19 is a perspective view of a former assembly wherein the stabilizer member is fully removed from the receiving orifice of the bracing post in an illustrative embodiment.
Figure 20:
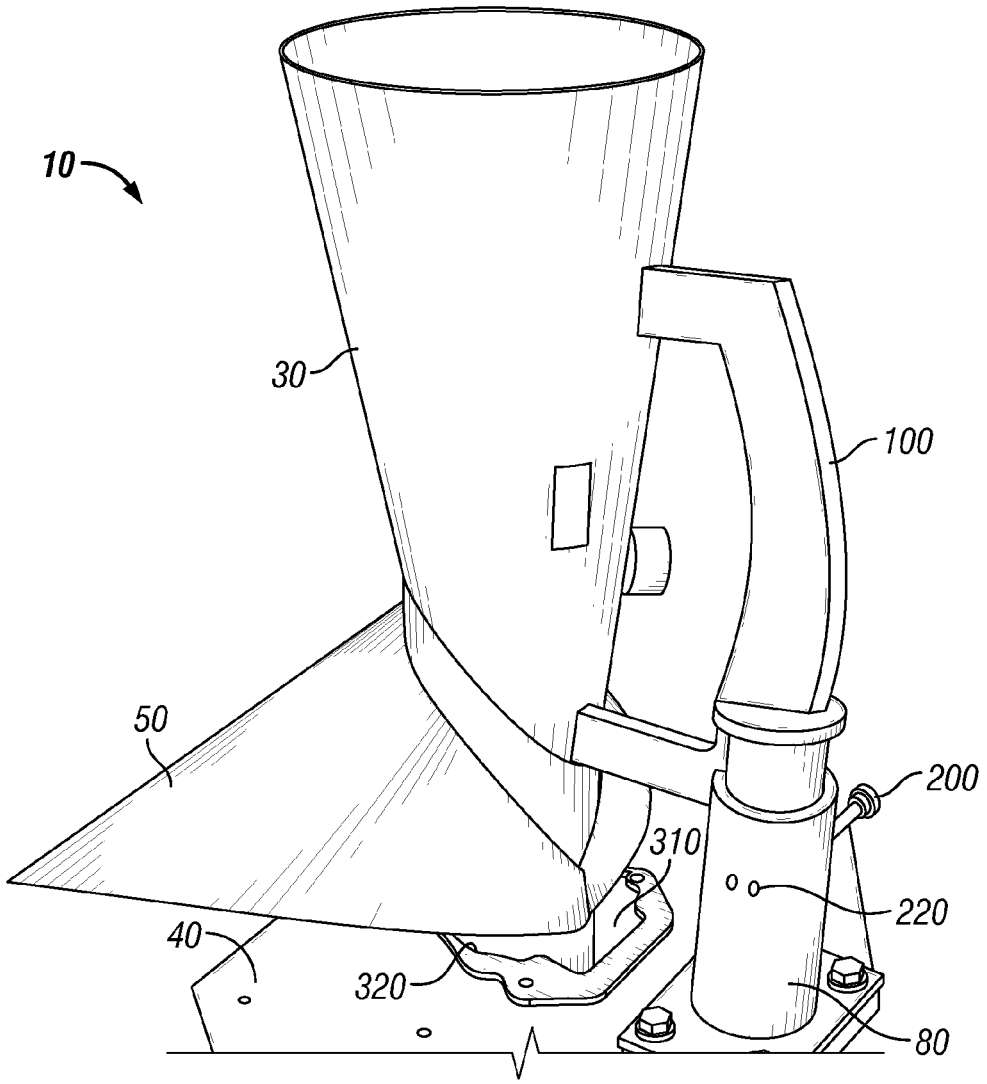
FIG. 20 is a perspective view of a former assembly wherein the stabilizer member is partially disposed within the receiving orifice of the bracing post in an illustrative embodiment.
Figure 22:
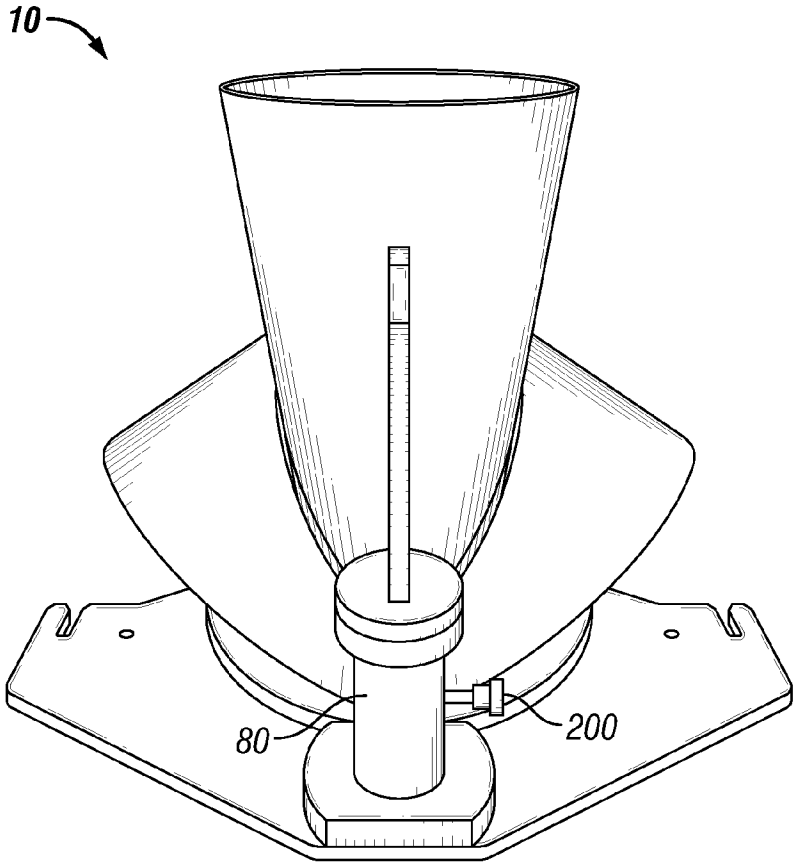
FIG. 22 is a front view of a former assembly wherein the stabilizer member has at least one locking orifice formed therein, the bracing post has at least one locking pin disposed therein, and the stabilizer member is disposed within the receiving orifice of the bracing post in an illustrative embodiment.
Figure 21:
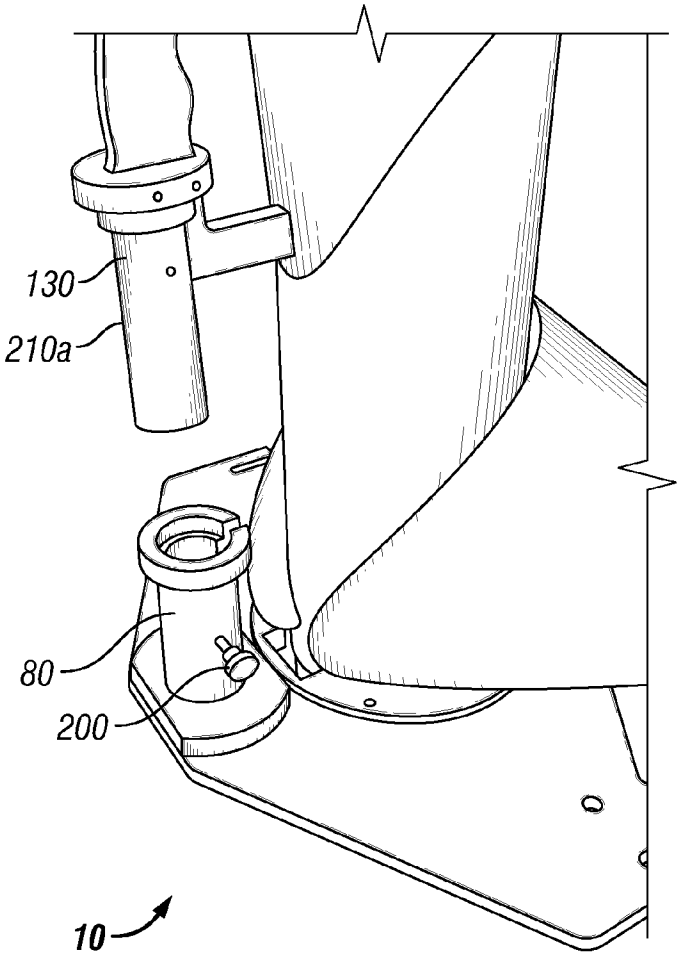
FIG. 21 is a perspective view of a former assembly wherein the stabilizer member has at least one locking orifice formed therein, the bracing post has at least one locking pin disposed therein, and the stabilizer member is not disposed within the receiving orifice of the bracing post in an illustrative embodiment.
Figure 24:
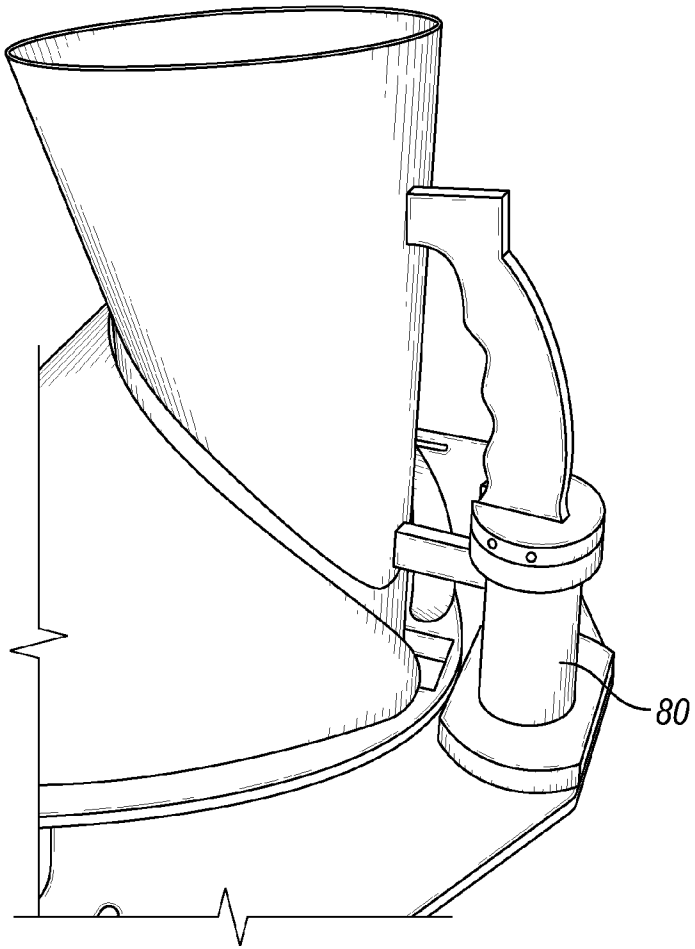
FIG. 24 is a perspective view of a former assembly wherein the stabilizer member is partially disposed within the receiving orifice of the bracing post in an illustrative embodiment.
Figure 23:
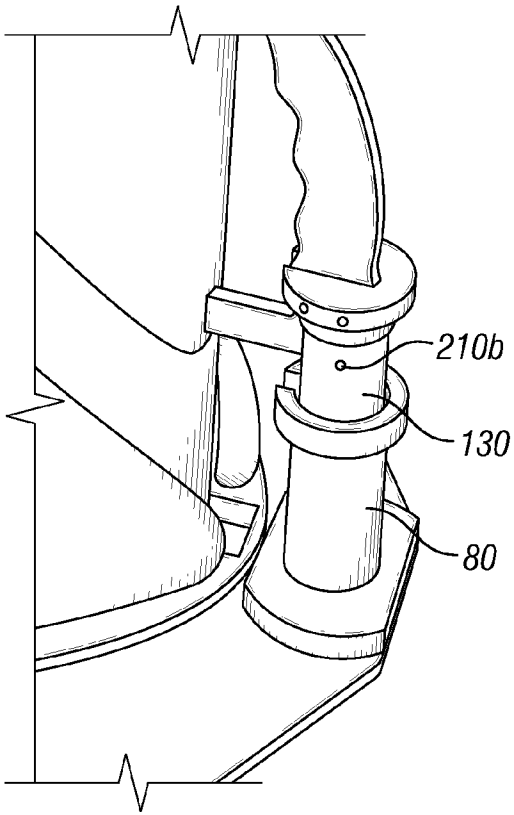
FIG. 23 is a side view of a former assembly wherein the stabilizer member is partially disposed within the receiving orifice of the bracing post in an illustrative embodiment.
Figure 26:
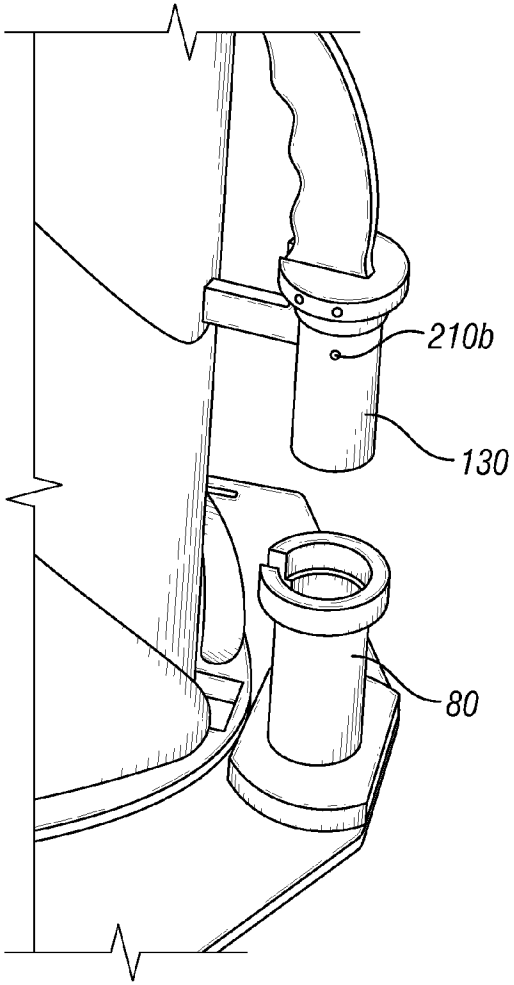
FIG. 26 is a side view of a former assembly wherein the stabilizer member is fully removed from the receiving orifice of the bracing post in an illustrative embodiment.
Figure 25:
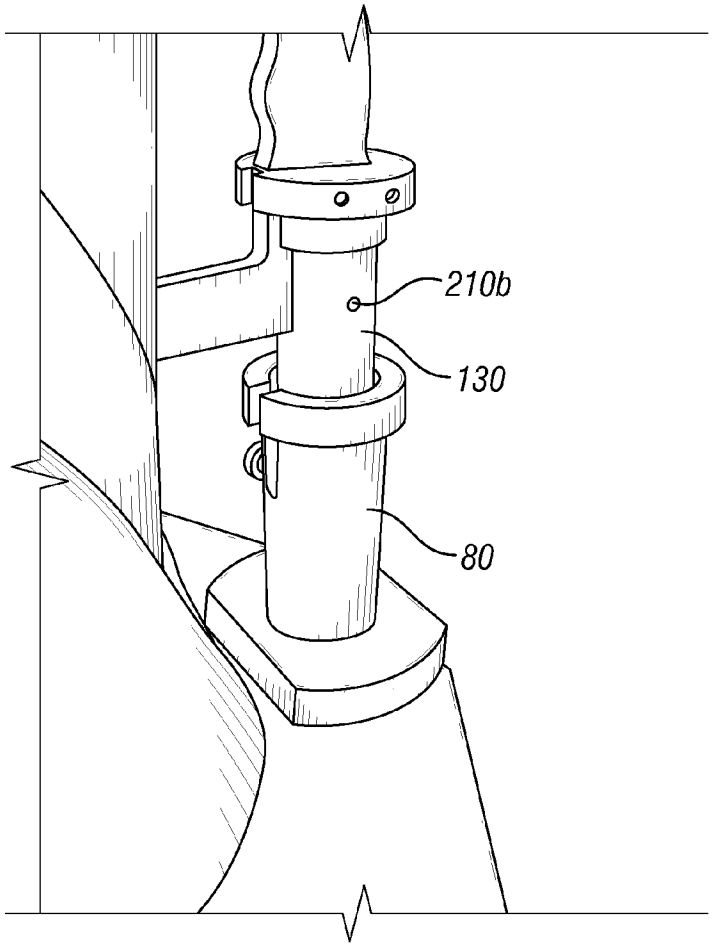
FIG. 25 is a perspective view of a former assembly wherein the stabilizer member is partially disposed within the receiving orifice of the bracing post in an illustrative embodiment.

In certain illustrative embodiments, a bracing arm 100 can be attached to fill tube 20, preferably at or near funnel section 30. Bracing arm 100 can extend outward from fill tube 20 and have a shape that would allow at least part of bracing arm 100 to slidingly fit at least partially within receiving orifice 90 of bracing post 80 when fill tube 20 is positioned within the central aperture 310 of base plate 40. Thus, the section of bracing arm 100 that fits within receiving orifice 90 of bracing post 80 should be aligned in a plane that is parallel to the plane of bracing post 80. Various illustrative embodiments of bracing arm 100 are shown in FIGS. 8-10. In an illustrative embodiment (FIG. 8), bracing arm 100 can comprise a handle arm 110 with a contact arm 120 extending therefrom and connecting to fill tube 20. In another illustrative embodiment (FIG. 9), bracing arm 100 can comprise a handle arm 110 with a plurality of contact arms 120 extending therefrom. Contact arms 120 can extend outward from fill tube 20 and connect fill tube 20 to handle arm 110. Handle arm 110 can be grasped by a user to move and position fill tube 20 with respect to base plate 40 and former wing 50. Handle arm 110 and contact arms 120 can be similarly shaped to form a generally uniform bracing arm 100, or alternatively, handle arm 110 and contact arms 120 can have different respective shapes and designs. For example, in an illustrative embodiment, handle arm 110 may contain a plurality of knurls for gripping purposes.

In certain illustrative embodiments, a stabilizer member 130 can be disposed on a bottom region of bracing arm 100. Stabilizer member 130 can extend in a generally downward direction and be aligned in a plane that is parallel to the plane of bracing post 80. Stabilizer member 130 can be sized to fit within receiving orifice 90 when fill tube 20 is positioned within the central aperture 310 of base plate 40. In certain illustrative embodiments, stabilizer member 130 can have a generally circular cross section. Stabilizer member 130 can slide into receiving orifice 90, and can be undersized by, for example, thousandths of an inch in both length and width to fit securely within receiving orifice 90. In other illustrative embodiments, the length and width of receiving orifice 90 and stabilizer member 130 can be sized as necessary to achieve the desired fit and/or desired stability for bracing arm 100.

In certain illustrative embodiments (e.g., FIGS. 15-18), bracing arm 100 can have a shoulder 140 disposed on its bottom region with an downward facing engagement surface 150 formed thereon, and bracing post 80 can have a shoulder 160 disposed on its upper region with a upward facing engagement surface 170 formed thereon. Engagement surface 150 of shoulder 140 can be adapted to contact engagement surface 170 of shoulder 160 when bracing arm 100 is fitted within receiving orifice 90 and advanced a sufficient distance, thus providing additional stability for bracing arm 100. Further, the location of shoulder 140 on bracing arm 100 can determine how far bracing arm 100 extends downward into receiving orifice 90, thus impacting the relative height of fill tube 20.

In certain illustrative embodiments (e.g., FIGS. 6-7), bracing post 80 can have a slot 180 formed therein adjacent to shoulder 160. Slot 180 can be sized to receive support arm, for example, contact arm 120, when bracing arm 100 is fitted within receiving orifice 90, thus allowing bracing arm 100 to advance an additional distance within receiving orifice 90 and provide additional stability for bracing arm 100. The length of slot 180 can be sized as needed to achieve the desired amount of stability. The support arm, for example, contact arm 120, can contact, or not contact, fill tube 20, as desired.

In certain illustrative embodiments (e.g., FIGS. 21-22), one or more locking pins 200 can be disposed within bracing post 80. For example, locking pin 200 can fit within an orifice 220 (see, e.g., FIG. 19), formed in the wall of bracing post 80. One or more locking orifices 210 can be formed in stabilizer member 130. Locking orifice 210 can be sized such that locking pin 200 can fit within and pass through locking orifice 210 when stabilizer member 130 is fitted within bracing post 80. In certain illustrative embodiments, locking pin 200 can pass through a first locking orifice **210*a* formed on one side of stabilizer member 130, and extend out of a second locking orifice 210*b* formed on the other side of stabilizer member 130. Locking pin 200 can secure stabilizer member 210 within bracing post 80** and prevent accidental removal.

Fill tube 20 may be removed from assembly 10 (as for cleaning) by, for example, slideably removing stabilizer member 130 from receiving orifice 90 of bracing post 80. Replacement of fill tube 80 on assembly 10 may be accomplished by, for example, reversing the above-described steps and slideably inserting stabilizer member 130 into receiving orifice 90 of bracing post 80. In this regard, FIGS. 19-20 and 23-26 show various views of assembly 10 wherein stabilizer member 130 is fully removed from, or fully or partially disposed within, receiving orifice 90 of bracing post 80 in certain illustrative embodiments.

The various illustrative embodiments of the bag forming assembly described herein are stable and easy to disassemble, reassemble and align for cleaning and maintenance purposes without tools or extensive experience. The various components of the bag forming assembly are formed of stainless steel and designed to lock into one another seamlessly.

It is to be understood that the invention is not limited to the exact details of construction, operation, exact materials, or illustrative embodiments shown and described, as modifications and equivalents will be apparent to one skilled in the art. For example, the size and shape of the receiving orifice and bracing post can also be rectangular, polygonal or any shape desired by the user. Accordingly, the invention is therefore to be limited only by the scope of the appended claims.

What is claimed is:

1. A former assembly for forming bags from flexible sheet material comprising:

a base plate having an aperture formed therein;

a single bracing post attached to the base plate proximate to the aperture, the bracing post having a receiving orifice formed therein and extending longitudinally therethrough;

a fill tube slidingly passable through the aperture in the base plate with an annulus between the fill tube and the base plate sized for the passage of the flexible sheet material;

and a bracing arm attached to the fill tube and slidingly fittable within the receiving orifice.

2. The assembly of claim 1, further comprising a first shoulder disposed on the bracing arm with a downward facing engagement surface and a second shoulder disposed on the bracing post with an upward facing engagement surface, such that the downward facing engagement surface is capable of contacting the upward facing engagement surface when the bracing arm is slidingly fitted into the receiving orifice.

3. The assembly of claim 1, further comprising a support arm extending from the bracing arm and a slot formed in the bracing post adjacent to the receiving orifice, wherein the slot is sized to receive the support arm when the bracing arm is slidingly fitted into the receiving orifice.

4. The assembly of claim 3, wherein the support arm is affixed to the fill tube.

5. The assembly of claim 1, further comprising a first locking orifice formed in the bracing post, a second locking orifice formed in the bracing arm, and a locking pin slidingly fittable within the first locking orifice and the second locking orifice and capable of securing the bracing arm to the bracing post.

6. The assembly of claim 1, wherein the bracing arm has a stabilizer member attached thereto and extending therefrom that is slidingly fittable into the receiving orifice and aligned parallel to the bracing post.

7. The assembly of claim 1, wherein the bracing arm comprises a plurality of contact arms attached to the fill tube at spaced apart locations, a handle arm disposed between the contact arms, and a stabilizer member that is slidingly fittable into the receiving orifice, and wherein at least one of the contact arms is disposed below the uppermost part of the bracing arm when the stabilizer member is slidingly fitted into the receiving post.

8. A method of removing a fill tube from a former assembly for fabricating bags from flexible sheet material, the method comprising:

providing a base plate with an aperture formed therein and a single bracing post attached to the base plate proximate to the aperture, the bracing post having a receiving orifice formed therein;

providing a fill tube having a bracing arm attached thereto, the fill tube disposed in the aperture in the base plate;

slidingly passing the fill tube out of the aperture in the base plate; and slidingly removing the bracing arm out of the receiving orifice such that the bracing arm is no longer disposed within the receiving orifice.

9. The method of claim 8, further comprising:

providing a support arm extending from the bracing arm;

providing a slot formed in the bracing post adjacent to the receiving orifice; and slidingly removing the support arm from the slot.

10. The method of claim 8, further comprising:

providing a first locking orifice formed in the bracing post;

providing a second locking orifice formed in the bracing arm; and removing a locking pin from the first locking orifice and the second locking orifice to unsecure the bracing arm from the bracing post.

11. A method of replacing a fill tube on a former assembly for fabricating bags from flexible sheet material, the method comprising:

providing a base plate with an aperture formed therein and a single bracing post attached to the base plate proximate to the aperture, the bracing post having a receiving orifice formed therein;

providing a fill tube having a bracing arm attached thereto;

slidingly passing the fill tube through the aperture in the base plate;

providing an annulus between the fill tube and the base plate sized for the passage of the flexible sheet material; and engaging the bracing arm with the bracing post and slidingly fitting the bracing arm into the receiving orifice such that the bracing arm is disposed within the receiving orifice.

12. The method of claim 11, further comprising:

providing a support arm extending from the bracing arm;

providing a slot formed in the bracing post adjacent to the receiving orifice; and slidingly fitting the support arm into the slot.

13. The method of claim 11, further comprising:

providing a first locking orifice formed in the bracing post;

providing a second locking orifice formed in the bracing arm; and inserting a locking pin within the first locking orifice and the second locking orifice to secure the bracing arm to the bracing post.

14. The assembly of claim 7, wherein the handle arm comprises a single handle arm that is oriented substantially parallel to the fill tube and the plurality of contact arms comprise a pair of contact arms that each contact the single handle arm and extend longitudinally from the single handle arm towards the direction of the fill tube to contact the fill tube.

15. The assembly of claim 1, wherein the receiving orifice extends substantially towards the bottom of the single bracing post.

16. The assembly of claim 1, wherein the longitudinal extent of the single bracing post is perpendicular to the base plate.

17. The assembly of claim 16, wherein the bottom section of the single bracing post is flush with the base plate.

18. The assembly of claim 1, wherein the single bracing post is cylindrically shaped along its entire longitudinal extent.

19. The assembly of claim 1, wherein the bracing arm is slidingly removable from the receiving orifice of the single bracing post.

* * * * *